US008266934B2

(12) United States Patent
Lin

(10) Patent No.: US 8,266,934 B2
(45) Date of Patent: Sep. 18, 2012

(54) KEYED CYLINDER ASSEMBLY FOR DOOR LOCK

(75) Inventor: Chung-Liang Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 589 days.

(21) Appl. No.: 12/476,339

(22) Filed: Jun. 2, 2009

(65) Prior Publication Data

US 2010/0300161 A1 Dec. 2, 2010

(51) Int. Cl.
*E05B 35/08* (2006.01)

(52) U.S. Cl. ..... 70/337; 70/367; 70/379 R; 70/493

(58) Field of Classification Search ..... 70/337, 70/338, 340, 342, 367, 373, 379 R, 380, 490–493
See application file for complete search history.

(56) References Cited

U.S. PATENT DOCUMENTS 3,090,219 A * 5/1963 Levin ..... 70/340
3,704,608 A * 12/1972 Kloosterziel ..... 70/340
4,123,926 A * 11/1978 Elder ..... 70/369
4,376,381 A * 3/1983 Muus ..... 70/337
4,631,941 A * 12/1986 Sjunnesson ..... 70/337
4,672,827 A * 6/1987 Craig ..... 70/367
5,000,019 A * 3/1991 Foster ..... 70/338
5,046,342 A * 9/1991 Urby ..... 70/337
5,138,856 A * 8/1992 Chyun ..... 70/493
2005/0235713 A1* 10/2005 Johansson et al. ..... 70/337

* cited by examiner

*Primary Examiner* — Christopher Boswell
(74) *Attorney, Agent, or Firm* — Alan Kamrath; Kamrath IP Lawfirm, PA

(57) ABSTRACT

A keyed cylinder assembly (10) includes a keyed cylinder (3) mounted in a door lock (1) and including a hollow body (31) and a cylinder plug (32) rotatably received in the hollow body (31). The cylinder plug (32) includes an annular groove (327) formed in an outer periphery (320) thereof. The keyed cylinder (3) further includes an arresting member (37) received in the hollow body (31) and having an inner end (371) received in the annular groove (327). The keyed cylinder assembly further includes a first key (4) insertable into a keyway (323) of the cylinder plug (32) to operate both a latch bolt (12) and a deadbolt (13) of the door lock (1). The keyed cylinder assembly (10) further includes a second key (5) insertable into the keyway (323) of the cylinder plug (32) to operate the latch bolt (12) only.

3 Claims, 14 Drawing Sheets

KEYED CYLINDER ASSEMBLY FOR DOOR LOCK

BACKGROUND OF THE INVENTION

The present invention relates to a keyed cylinder assembly for a door lock and, more particularly, to a keyed cylinder assembly including a keyed cylinder that allow insertion of either a first key capable of unlatching both a latch bolt and a deadbolt of the door lock or a second key capable of unlatching the latch bolt only.

Typical mortise locks include a latch bolt and a deadbolt both mounted in a case to lock a door to which the lock is mounted. Generally, the mortise locks further include a keyed cylinder to allow operation of both the latch bolt and the deadbolt from the outdoors by using a key. In mortise locks for use in hotel room doors, the keyed cylinder is required to cooperate with two different keys known as a master key and a service key, allowing a holder, such as a hotel manager, of the master key to operate both the latch bolt and the deadbolt from the outdoors while a holder, such as a room guest, of the service key can operate only the latch bolt from the outdoors. In a case that the room guest is intended to stay longer but refuses to pay the current bill, the hotel manager may move the deadbolt to a locking position with the master key to prevent the room guest from entering the room before the current bill is paid up. Thus, not only the payment problem of the room guest can be solved but also the possibility of burglary resulting from copied or lost service keys can be reduced. In such an operation mode allowing the deadbolt to be unlocked by the master key but not by the service key, a keyed cylinder with a special mechanism is required in which the service key can only rotate a cylinder plug of the keyed cylinder in a restricted angular range while the master key can rotate the cylinder plug 360 degrees. However, structures of the keyed cylinders of mortise locks are generally complicated, resulting in assembling difficulties, frequent malfunction, and increased costs.

Thus, a need exists for a keyed cylinder that can be operated by either a master key capable of unlatching both a latch bolt and a deadbolt of a door lock or a service key capable of unlatching the latch bolt only while having simplified structure and allowing smooth operation by the master and service keys.

BRIEF SUMMARY OF THE INVENTION

The present invention solves this need and other problems in the field of keyed cylinders of mortise locks by providing, in a preferred form, a keyed cylinder assembly including a keyed cylinder adapted to be mounted in a door lock having a latch bolt and a deadbolt. The keyed cylinder includes a hollow body and a cylinder plug rotatably received in the hollow body about an axis. The cylinder plug includes front and rear ends spaced along the axis and an outer periphery surrounding the axis. The cylinder plug further includes a keyway extending from the first end through the second end along the axis and extending from an interior of the cylinder plug to the outer periphery in a radial direction perpendicular to the axis. The keyway includes a radial outer portion in the outer periphery and extending along the axis. The cylinder plug further includes an annular groove formed in the outer periphery and intersecting the radial outer portion of the keyway. The keyed cylinder further includes a first arresting member received in the hollow body and having an inner end received in the annular groove of the cylinder plug. The inner end of the first arresting member has a first length along the axis. The keyed cylinder assembly further includes a first key having a first blade insertable into the keyway of the cylinder plug. The first blade includes a side extending along the axis. A notch is formed in the side of the first blade and has a second length along the axis not smaller than the first length. The side of the first blade is received in the radial outer portion of the keyway when the first blade is received in the keyway. The keyed cylinder assembly further includes a second key having a second blade insertable into the keyway of the cylinder plug. The second blade includes a side extending along the axis. When the second blade is received in the keyway, the side of the second blade is received in the radial outer portion of the keyway, and a portion of the second side is received in the annular groove of the cylinder plug. When the first blade of the first key is inserted into the keyway of the cylinder plug and rotated, the cylinder plug rotates together with the first key, and the inner end of the first arresting member is received in the notch when the outer end of the keyway of the cylinder plug rotates to a first position in alignment with the inner end of the first arresting member, allowing 360° rotation of the cylinder plug in the hollow body for unlocking both the latch bolt and the deadbolt of the door lock. When the second blade of the second key is inserted into the keyway of the cylinder plug and rotated in a first direction, the cylinder plug rotates together with the second key until the portion of the second side of the second key contacts and is stopped by the inner end of the first arresting member when the radial outer portion of the keyway of the cylinder plug rotates to a second position adjacent to the inner end of the first arresting member, allowing unlatching the latch bolt of the door lock but not allowing 360° rotation of the cylinder plug in the hollow body for unlocking the deadbolt of the door lock.

In the most preferred form, the keyed cylinder assembly further includes a second arresting member received in the hollow body and angularly spaced from the first arresting member. The second arresting member includes an inner end received in the annular groove of the cylinder plug and having a third length along the axis not larger than the second length along the axis. When the second blade of the second key is inserted into the keyway of the cylinder plug and rotated in a second direction reverse to the first direction, the cylinder plug rotates together with the second key until the portion of the second side of the second key contacts and is stopped by the inner end of the second arresting member when the radial outer portion of the keyway of the cylinder plug rotates to a third position adjacent to the inner end of the second arresting member, allowing unlatching the latch bolt of the door lock but not allowing 360° rotation of the cylinder plug in the hollow body for unlocking the deadbolt of the door lock.

The present invention will become clearer in light of the following detailed description of illustrative embodiments of this invention described in connection with the drawings.

DESCRIPTION OF THE DRAWINGS

The illustrative embodiment may best be described by reference to the accompanying drawings where.

Figure 1:
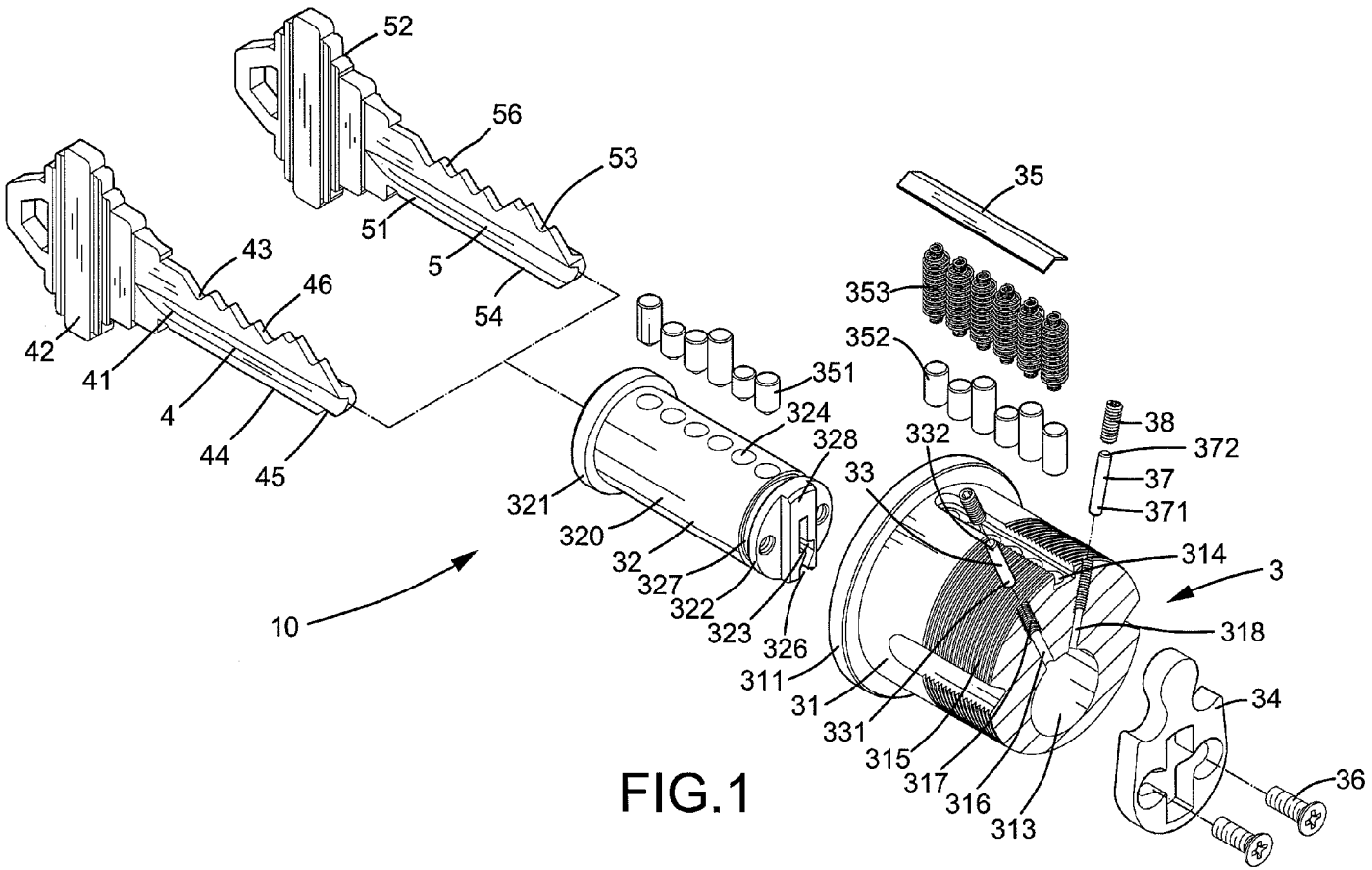
FIG. 1 shows an exploded, perspective view of a keyed cylinder assembly according to the preferred teachings of the present invention with a hollow body partly cutaway.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "section", "radial", "annular", "clockwise" "counterclockwise" "lateral" "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A keyed cylinder assembly according to the preferred teachings of the present invention is shown in the drawings and generally designated 10. Keyed cylinder assembly 10 can be utilized in a door lock 1 mounted in a door 2 (FIG. 11) for operating a latch bolt 12 and a deadbolt 13 of door lock 1.

According to the preferred form shown, keyed cylinder assembly 10 includes a keyed cylinder 3, a first key 4 and a second key 5. Keyed cylinder 3 includes a hollow body 31, a cylinder plug 32 rotatably received in hollow body 31 about an axis, and first and second arresting members 33 and 37. According to the preferred form shown, hollow body 31 includes first and second ends 311 and 312 spaced along the axis and a cylinder plug hole 313 extending from first end 311 through second end 312 along the axis. Hollow body 31 further includes a plurality of first tumbler pin holes 314 spaced from each other along the axis and each extending from an outer circumference 315 of hollow body 31 to cylinder plug hole 313. Each first tumbler pin hole 314 receives a first tumbler pin 352 and a spring 353 for biasing first tumbler pin 352 inward (see FIG. 2). A cover 35 is mounted on outer circumference 315 of hollow body 31 to shield and press against an outer end of each spring 353. Further, hollow body 31 includes first and second through-holes 316 and 318 formed in second end 312 thereof and angularly spaced from each other. Each of first and second through-holes 316 and 318 extends from outer circumference 315 of hollow body 31 to cylinder plug hole 313 and angularly spaced from first tumbler pin holes 314.

Figure 2:
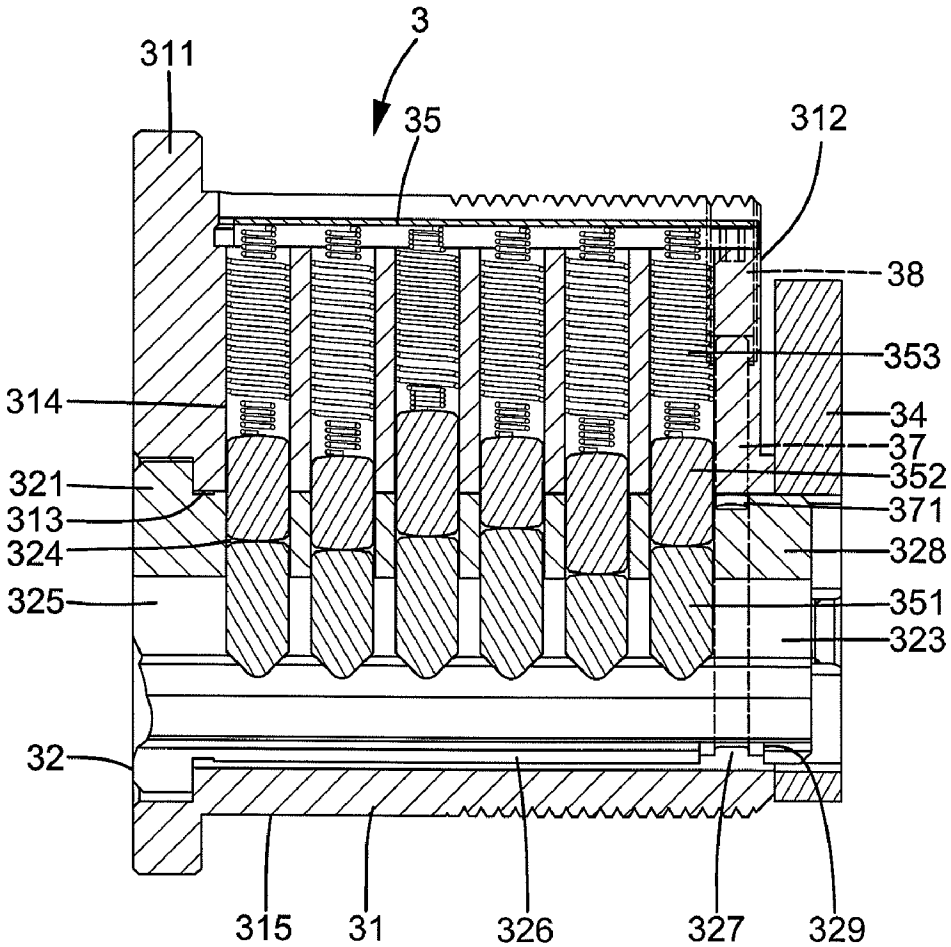
FIG. 2 shows a cross sectional view of a keyed cylinder of the keyed cylinder assembly of FIG. 1.
Figure 6:
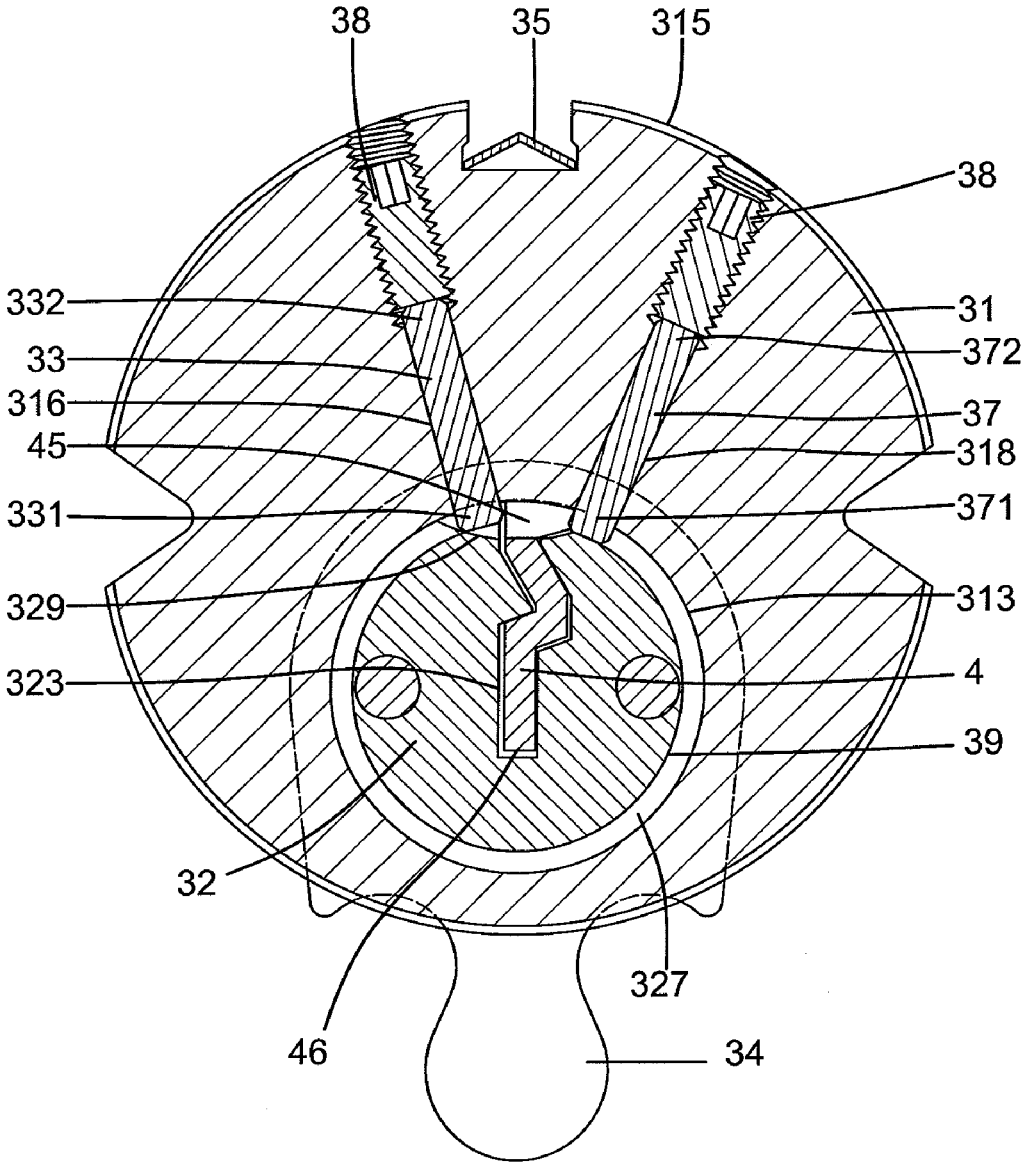
FIG. 6 shows a cross sectional view similar to FIG. 5, with a cylinder plug rotated 180°.

According to the preferred form shown, cylinder plug 32 includes front and rear ends 321 and 322 spaced along the axis and an outer periphery 320 surrounding the axis. Cylinder plug 32 is received in cylinder plug hole 313 of hollow body 31. Front end 321 includes a flange and is rotatably coupled in first end 311 of hollow body 31. Rear end 322 extends through second end 312 of hollow body 31. Cylinder plug 32 further includes a keyway 323 extending from front end 321 through rear end 322 along the axis and extending from an interior of the cylinder plug 32 to the outer periphery 320 in a radial direction perpendicular to the axis. Keyway 323 includes an insertion opening 325 in front end 321 and a radial outer portion 326 in the outer periphery 320 and extending along the axis. Cylinder plug 32 further includes a plurality of second tumbler pin holes 324 spaced from each other along the axis and each extending from outer periphery 320 to keyway 323. Each second tumbler pin hole 324 receives a second tumbler pin 351. When cylinder plug 32 is received in hollow body 31 in a predetermined position, second tumbler pin holes 324 are aligned with first tumbler pin holes 314 such that springs 353 bias inner ends of first tumbler pins 352 into second tumbler pin holes 324 and bias inner ends of second tumbler pins 351 into keyway 323, thereby locking cylinder plug 32 in hollow body 31 (FIG. 2). Cylinder plug 32 further includes a protrusion 328 formed on an end face of second end 322 thereof and located outside of second end 312 of hollow body 31. An actuating member 34 is attached to protrusion 328 of cylinder plug 32 by screws 36. Cylinder plug 32 further includes an annular groove 327 formed in outer periphery 320 and intersecting radial outer portion 326 of keyway 323. In the most preferred form shown, annular groove 327 includes a bottom wall 39 and an arcuate recess 329 formed in an intersecting section of bottom wall 39 and radial outer portion 326 of keyway 323 of cylinder plug 32 (FIG. 6).

According to the preferred form shown, each of first and second arresting members 33 and 37 is in the form of a pin and includes an inner end 331, 371. First arresting member 33 is received in first through-hole 316 with inner end 331 of first arresting member 33 extended through first through-hole 316 and received in annular groove 327 of cylinder plug 32. Second arresting member 37 is received in second through-hole 318 with inner end 371 of second arresting member 37 extended through second through-hole 318 and received in annular groove 327 of cylinder plug 32. Each of first and second arresting members 33 and 37 further includes an outer end 332, 372 adjacent outer circumference 315 of hollow body 31. A screw 38 is engaged in each of first and second through-holes 316 and 318 and presses against outer end 332, 372 of one of first and second arresting members 33 and 37 so that inner end 331, 371 of each of first and second arresting members 33 and 37 abuts bottom wall 39 of annular groove 327. Inner end 331, 371 of each of first and second arresting members 33 and 37 has a length along the axis.

According to the preferred form shown, first key 4 includes a bow 42 for a user's grip and a first blade 41 insertable into keyway 323 of cylinder plug 32. First blade 41 includes a first side 46 extending along the axis and having serrations 43. Further, first blade 41 includes a second side 44 extending along the axis and opposed to first side 46. First blade 41 further includes a notch 45 formed in second side 44 and having a length along the axis not smaller than the length of inner end 331, 371 of each of first and second arresting member 33 and 37. In the most preferred form shown, notch 45 is formed in an outer end edge of second side 44 of first blade 41. When first blade 41 is received into keyway 323 (FIG. 5), second side 44 of first blade 41 is received in radial outer portion 326 of keyway 323, and notch 45 is aligned with annular groove 327 of cylinder plug 32.

Second key 5 includes a bow 52 for the user's grip and a second blade 51 insertable into keyway 323 of cylinder plug 32. Second blade 51 includes a first side 56 extending along the axis and having serrations 53 similar to serrations 43 of first key 4. Further, second blade 51 includes a second side 54 extending along the axis and opposed to first side 56. When second blade 51 is received into keyway 323 (FIG. 7), second side 54 of second blade 51 is received in radial outer portion 326 of keyway 323, and a portion of second side 54 is received in annular groove 327 of cylinder plug 32.

Figure 3:
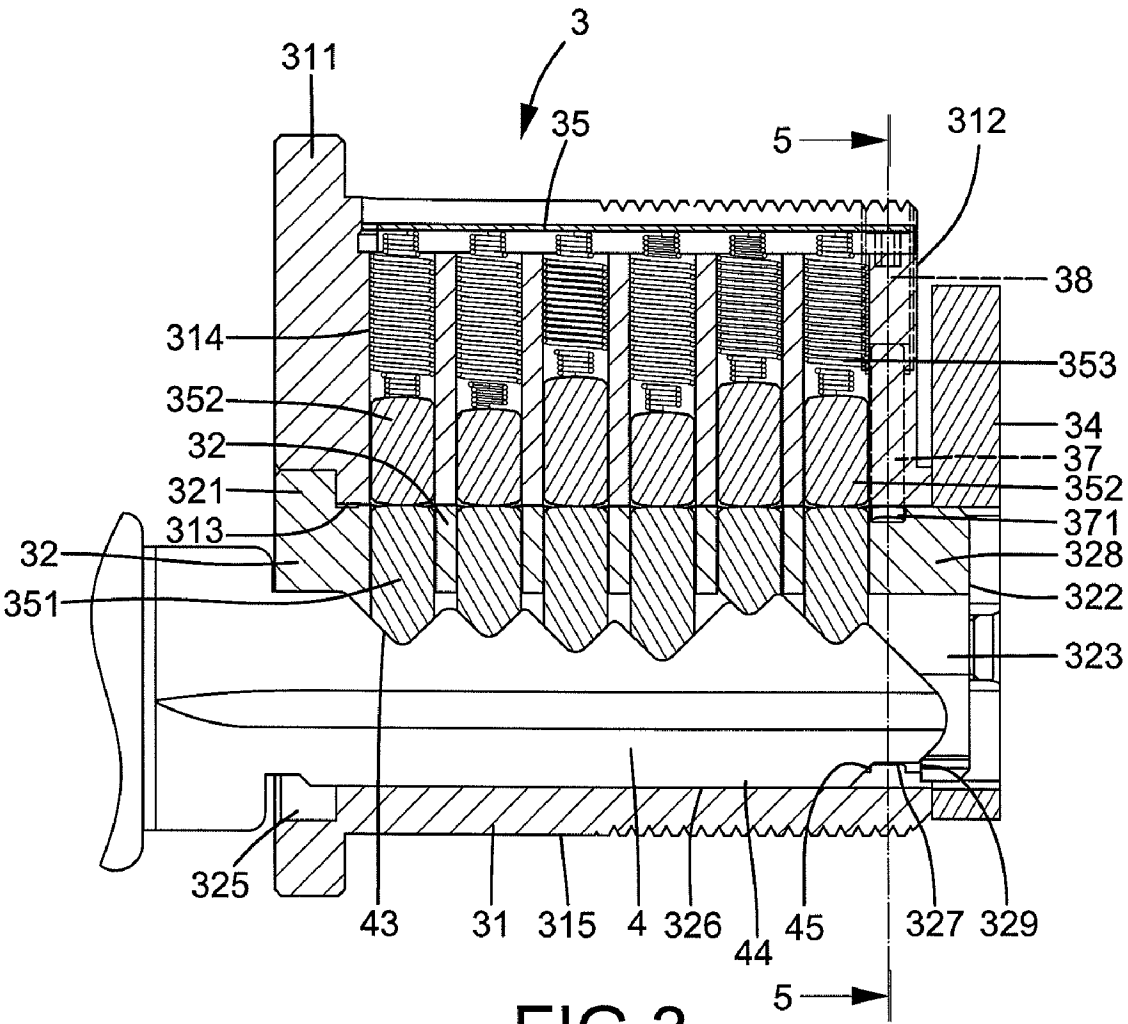
FIG. 3 shows a cross sectional view of the keyed cylinder of the keyed cylinder assembly of FIG. 1 with a first key inserted into a keyway of the keyed cylinder.
Figure 4:
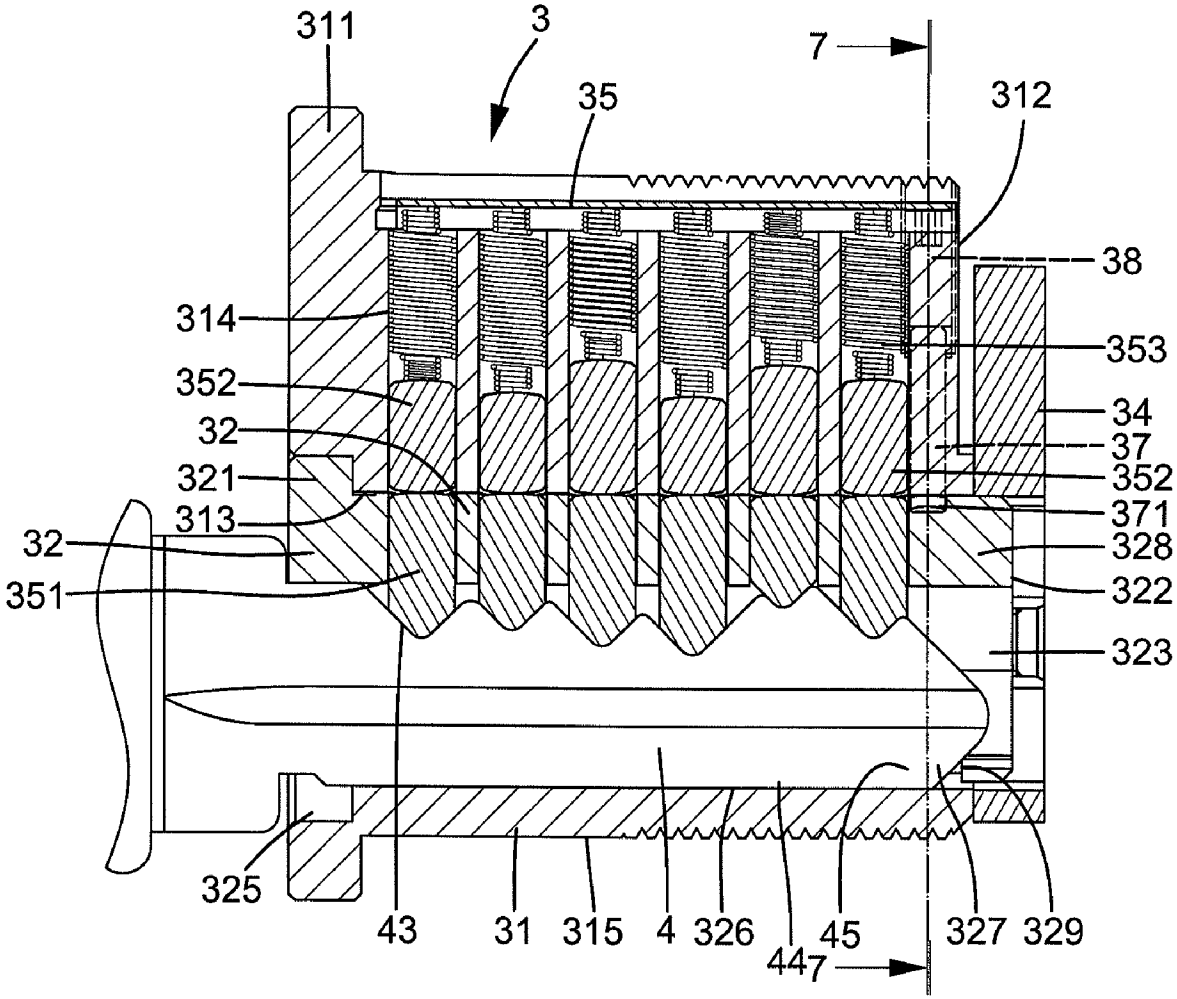
FIG. 4 shows a cross sectional view of the keyed cylinder of the keyed cylinder assembly of FIG. 1 with a second key inserted into the keyway of the keyed cylinder.

With reference to FIGS. 3 and 4, when either first blade 41 of first key 4 or second blade 51 of second key 5 is inserted into keyway 323 of cylinder plug 32, the inner ends of first tumbler pins 352 are lifted by serrations 43, 53 to a shear line between hollow body 31 and cylinder plug 32 and disengage from second tumbler pin holes 324 of cylinder plug 32, allowing cylinder plug 32 to be rotated in hollow body 31. Further, when first blade 41 of first key 4 is inserted into keyway 323 of cylinder plug 32 and rotated, cylinder plug 32 rotates together with first key 4, and inner end 331, 371 of each of first and second arresting members 33 and 37 is received in notch 45 when radial outer portion 326 of keyway 323 of cylinder plug 32 rotates to a position in alignment with inner end 331, 371 of one of first and second arresting members 33 and 37 (see FIGS. 5 and 6), allowing 360° rotation of cylinder plug 32 in hollow body 31. Further, inner end 331, 371 of each of first and second arresting members 33 and 37 abuts and is guided by arcuate recess 329 when radial outer portion 326 of keyway 323 of cylinder plug 32 rotates to the position in alignment with inner end 331, 371 of each of first and second arresting members 33 and 37 so that rotation of cylinder plug 32 in hollow body 31 is smooth.

Figure 7:
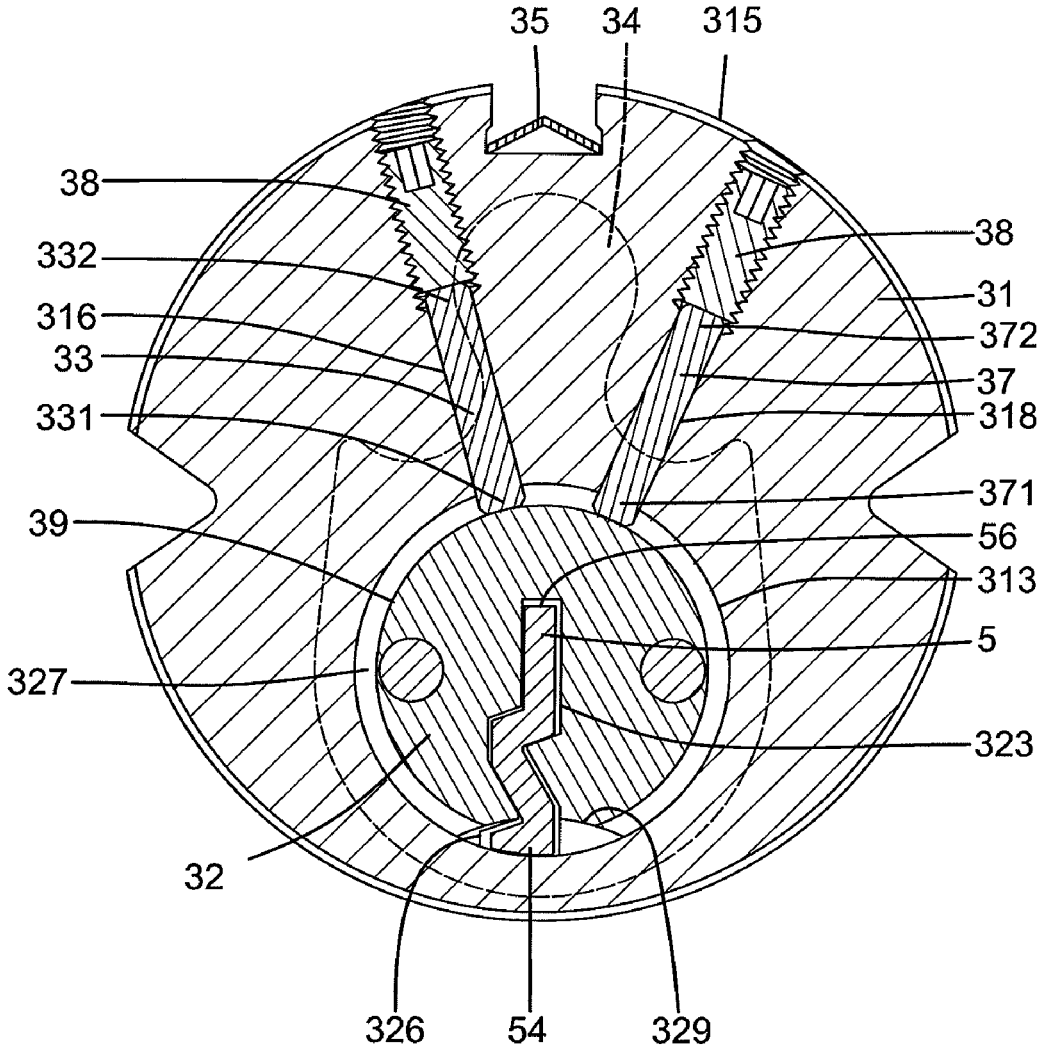
FIG. 7 shows a cross sectional view of the keyed cylinder of the keyed cylinder assembly of FIG. 1 taken along section line 7-7 of FIG. 4.
Figure 8:
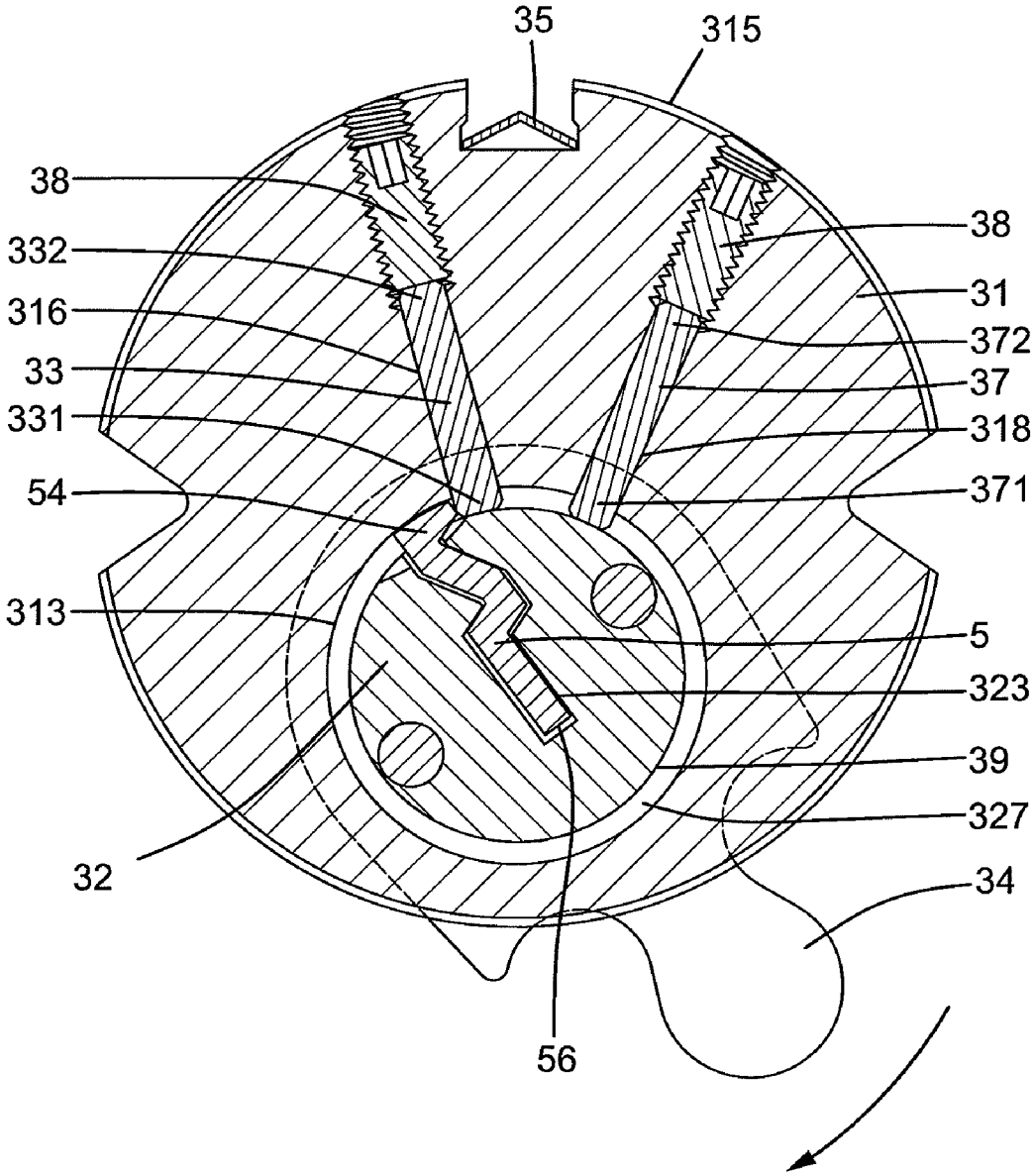
FIG. 8 shows a cross sectional view similar to FIG. 7, with the cylinder plug rotated in a clockwise direction to a position contacting an inner end of one arresting member.
Figure 9:
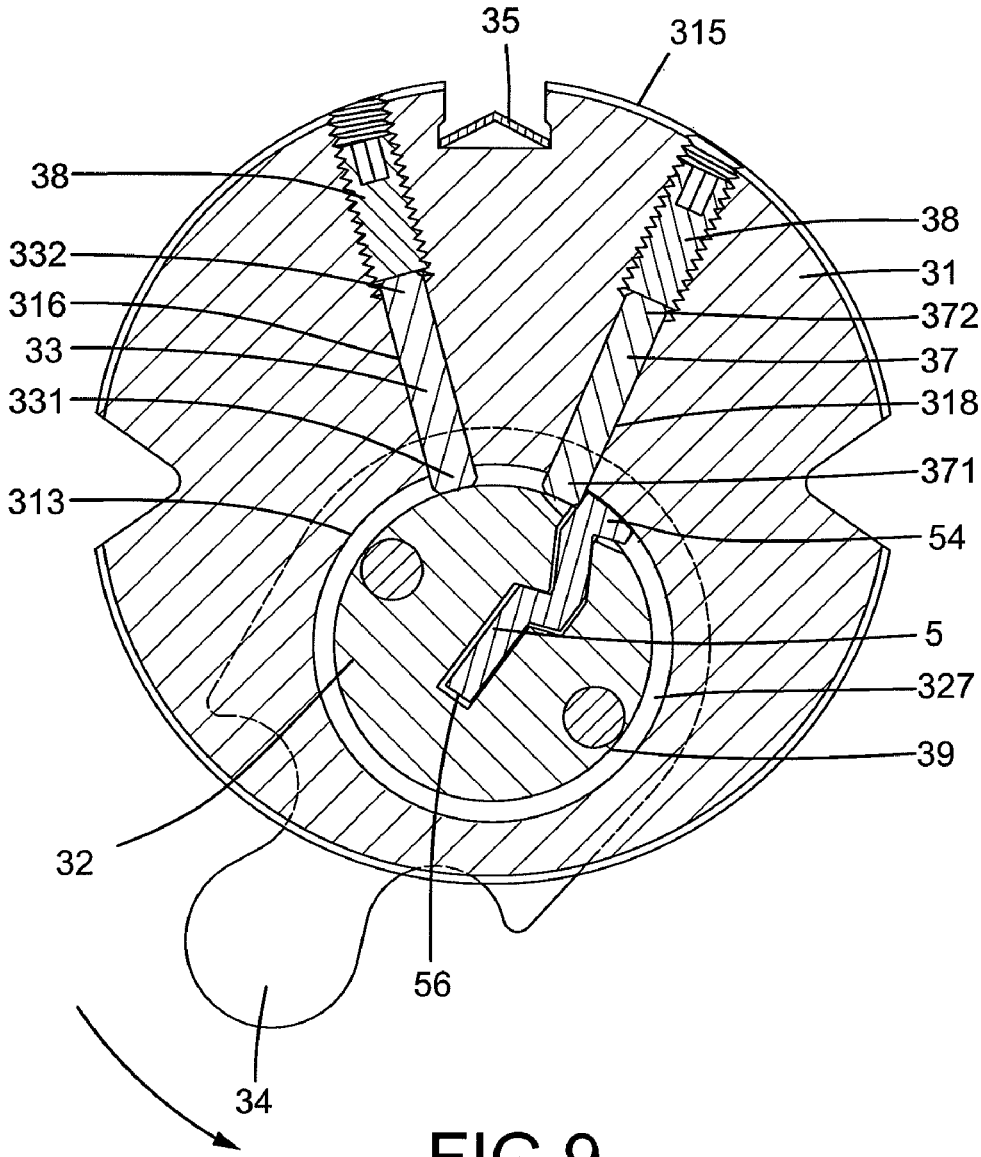
FIG. 9 shows a cross sectional view similar to FIG. 7, with the cylinder plug rotated in a counterclockwise direction to a position contacting an inner end of another arresting member.

With reference to FIGS. 7 and 8, when second blade 51 of second key 5 is inserted into keyway 323 of cylinder plug 32 and rotated in a clockwise direction, cylinder plug 32 rotates together with second key 5 until the portion of second side 54 of second key 5 contacts and is stopped by inner end 331 of first arresting member 33 when radial outer portion 326 of keyway 323 of cylinder plug 32 rotates to a position adjacent to inner end 331 of first arresting member 33, not allowing 360° rotation of cylinder plug 32 in hollow body 31. With reference to FIGS. 7 and 9, when second blade 51 of second key 5 is inserted into keyway 323 of cylinder plug 32 and rotated in a counterclockwise direction, cylinder plug 32 rotates together with second key 5 until the portion of second side 54 of second key 5 contacts and is stopped by inner end 371 of second arresting member 37 when radial outer portion 326 of keyway 323 of cylinder plug 32 rotates to a position adjacent to inner end 371 of second arresting member 37, not allowing 360° rotation of cylinder plug 32 in hollow body 31.

Figure 5:
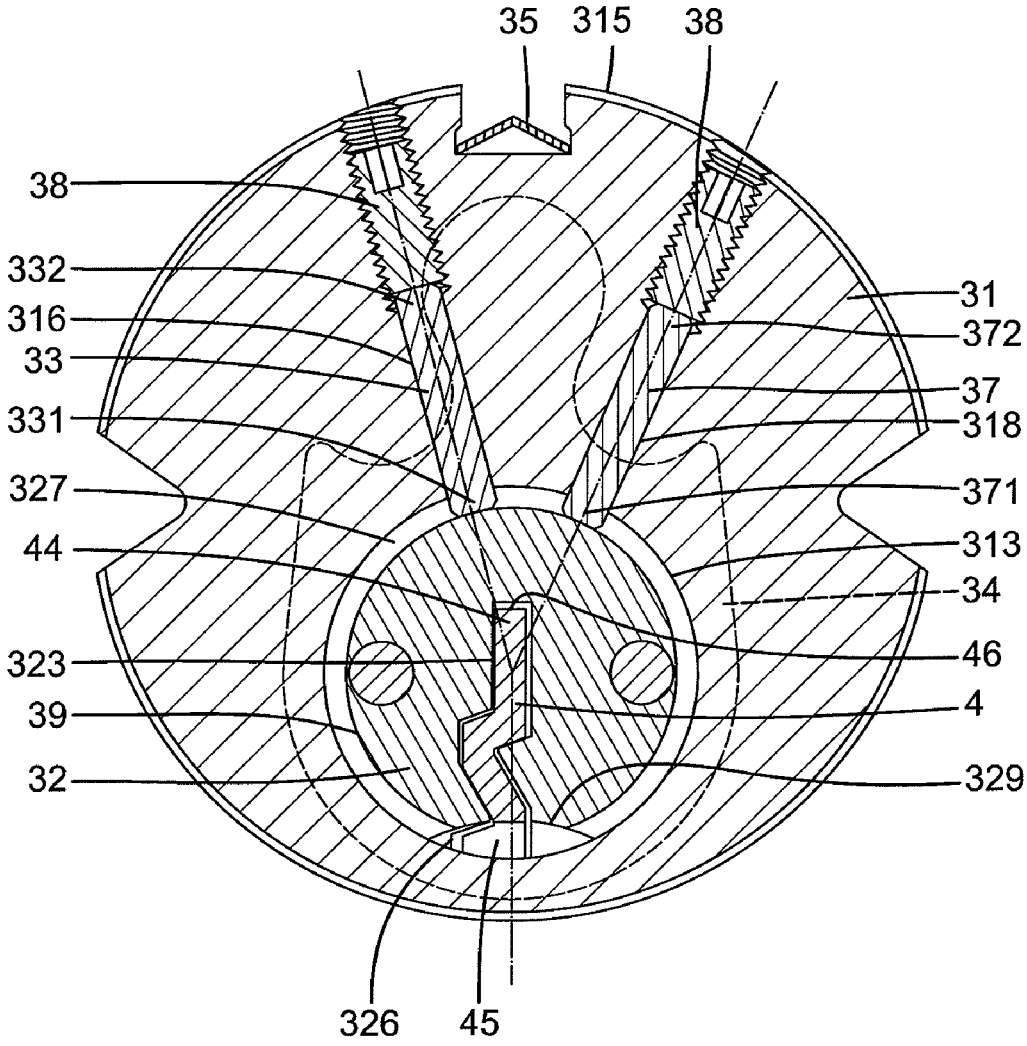
FIG. 5 shows a cross sectional view of the keyed cylinder of the keyed cylinder assembly of FIG. 1 taken along section line 5-5 of FIG. 3.

Further, in the most preferred form shown, when cylinder plug 32 is not rotated by either of first and second keys 4 and 5, inner end 331 of first arresting member 33 is angularly spaced from radial outer portion 326 of keyway 323 about 156° in the clockwise direction while inner end 371 of second arresting member 37 is angularly spaced from radial outer portion 326 of keyway 323 about 166° in the counterclockwise direction (see FIGS. 5 and 7).

Figure 10:
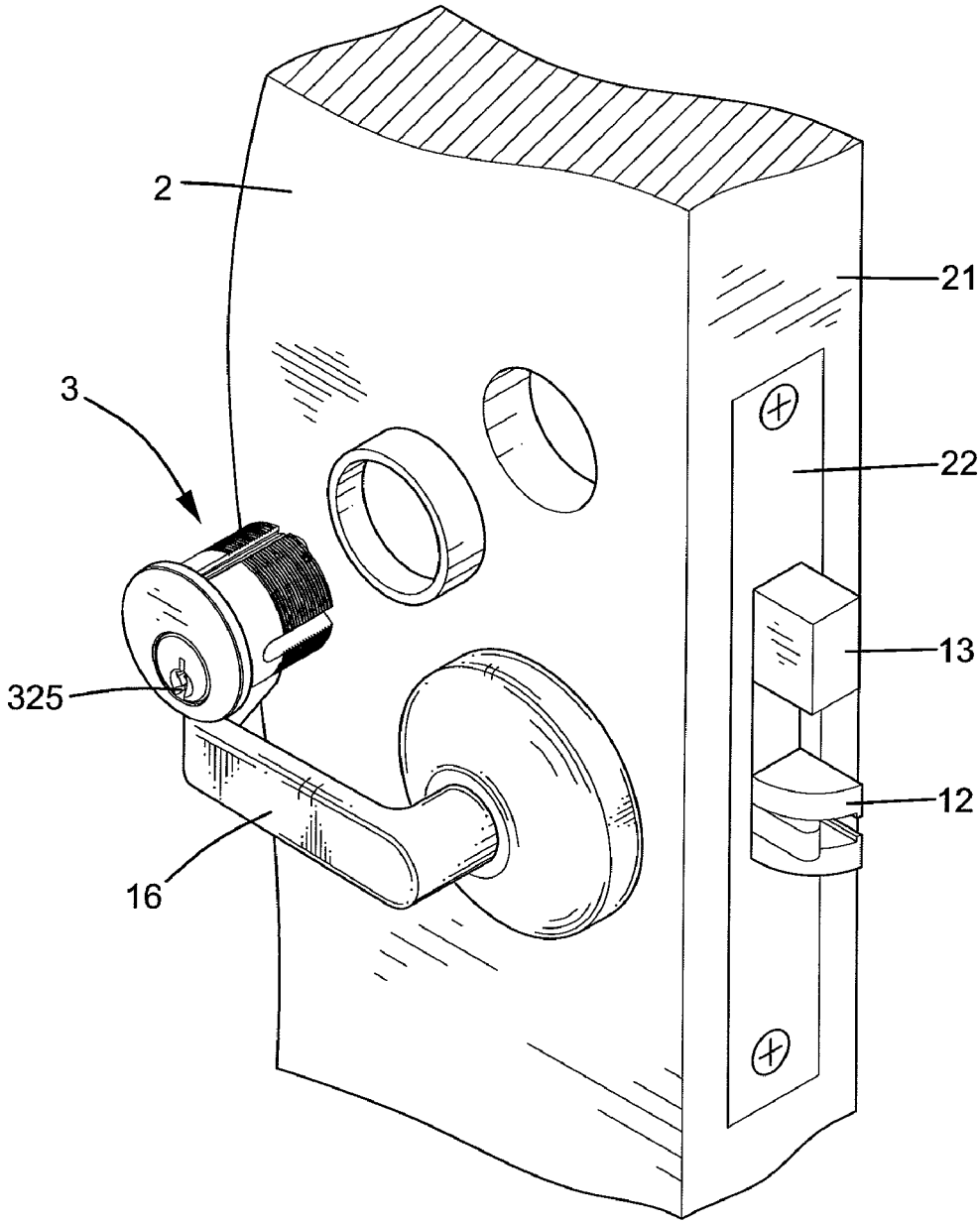
FIG. 10 shows a perspective view of the keyed cylinder of the keyed cylinder assembly of FIG. 2 and a door in which a door lock receiving the keyed cylinder is mounted.
Figure 11:
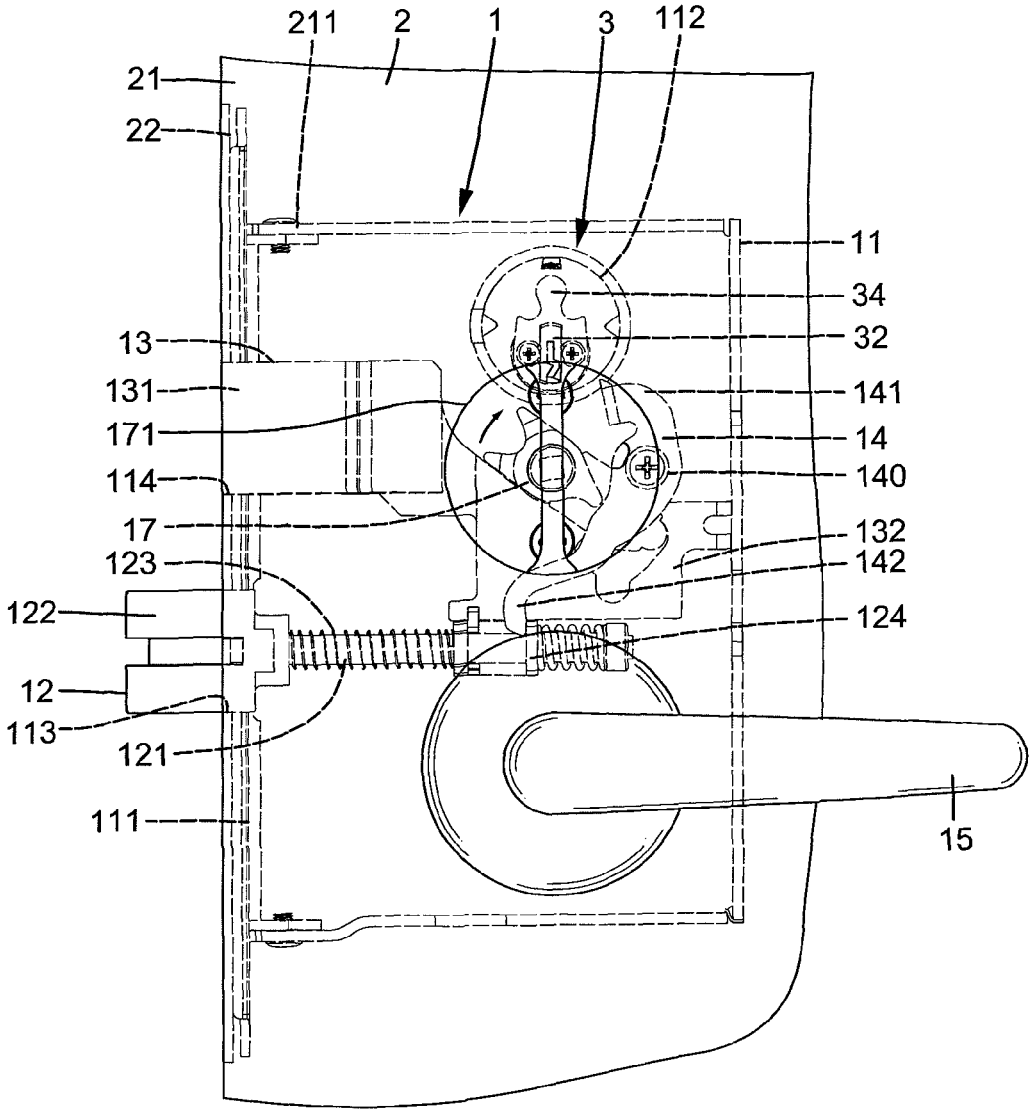
FIG. 11 shows a cross sectional view of the keyed cylinder assembly, the door, and the door lock of FIG. 10, with a latch bolt in an extended position and a dead bolt in a retracted position.
Figure 12:
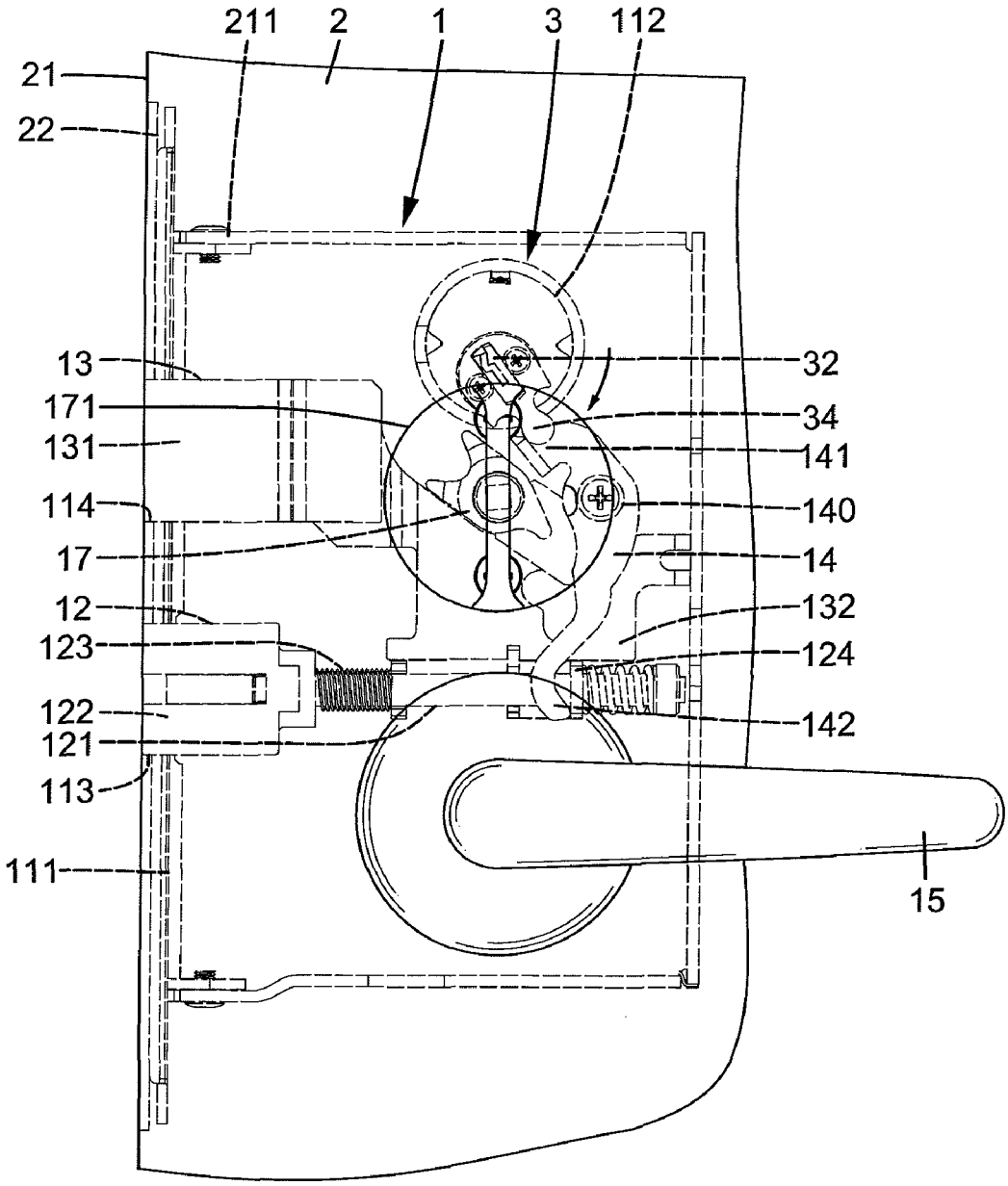
FIG. 12 shows a cross sectional view similar to FIG. 11, with both of the latch bolt and the deadbolt in retracted positions.

With reference to FIGS. 10 to 12, door lock 1 includes a substantially parallelepiped case 11 received in a compartment 211 in a side 21 of door 2 and fixed by a faceplate 22 attached to side 21 of door 2. Case 11 includes a front end face 111 and a keyed cylinder-receiving hole 112 in which keyed cylinder 3 is received. Latch bolt 12 includes a head 122 and a shank 121 extending from head 122 through an opening 113 into case 11. Head 122 of latch bolt 12 includes triangular cross sections and is normally biased by a spring 123 to an extended, latching position outside of case 11. A substantially U-shaped bracket 124 is mounted on shank 121. An inside handle 15 and an outside handle 16 are respectively mounted to two sides of case 11. Inside and outside handles 15 and 16 are operable to retract latch bolt 12 from the extended position to the retracted position through an actuating mechanism operably connected to bracket 124.

Deadbolt 13 is in the form of a parallelepiped and includes a front end 131 extendible through another opening 114 in case 11 between an extended, locking position outside of case 11 and a retracted, unlocking position inside of case 11. Deadbolt 13 further includes a rear end 132 to which a pivotal member 17 is connected. A turnknob 171 is mounted on an inner side of door 2 and connected with pivotal member 17 so that pivotal member 17 can be turned to actuate rear end 132 of deadbolt 13 by operation of turnknob 171, which, in turn, moves front end 131 of deadbolt 13 between the extended, locking position outside of case 11 and the retracted, unlocking position inside of case 11.

A lever link 14 is pivotally mounted around a pivot 140 formed in case 11 and includes a first end 141 adjacent to keyed cylinder 3 and a second end 142 releasably engaged with bracket 124 of latch bolt 12. Lever link 14 can be driven by actuating member 34 of cylinder plug 32 so as to move latch bolt 12 from the extended, latching position to the retracted, unlatching position inside of case 11. Specifically, when deadbolt 13 is in the retracted, unlocking position inside of case 11 (FIG. 11) and when either of first and second keys 4 and 5 is inserted into keyway 323 of cylinder plug 32 and rotated, actuating member 34 is rotated in a clockwise direction indicated by the arrow in FIG. 12 to actuate first end 141 of lever link 14 to move bracket 124 inward after about 143° rotation of cylinder plug 32, which, in turn, moves latch bolt 12 inward to its retracted, unlatching position (see FIG. 12). Thus, either of first and second keys 4 and 5 can be used to unlatch latch bolt 12 when deadbolt 13 is in the retracted, unlocking position inside of case 11.

FIG. 11 shows deadbolt 13 in the retracted, unlocking position. When turnknob 171 is rotated to move pivotal member 17 in a clockwise direction indicated by the arrow in FIG. 11, rear end 132 of deadbolt 13 is actuated so that deadbolt 13 is moved outward to its extended, locking position (see FIG. 13), and lever link 14 is also actuated so that first end 141 of lever link 14 is outside of the rotation track of actuating member 34 and that second end 142 of lever link 14 is disengaged from bracket 124 of latch bolt 12. Further, operation of deadbolt 13 from the retracted, unlocking position to the extended, locking position can be accomplished by first key 4.

Specifically, when first key 4 is inserted into keyway 323 of cylinder plug 32 and rotated to move actuating member 34 in a counterclockwise direction, rear end 132 of deadbolt 13 is actuated so that deadbolt 13 is moved outward to its extended, latching position, and lever link 14 is also actuated so that first end 141 of lever link 14 is outside of the rotation track of actuating member 34 and that second end 142 of lever link 14 is disengaged from bracket 124 of latch bolt 12.

Figure 13:
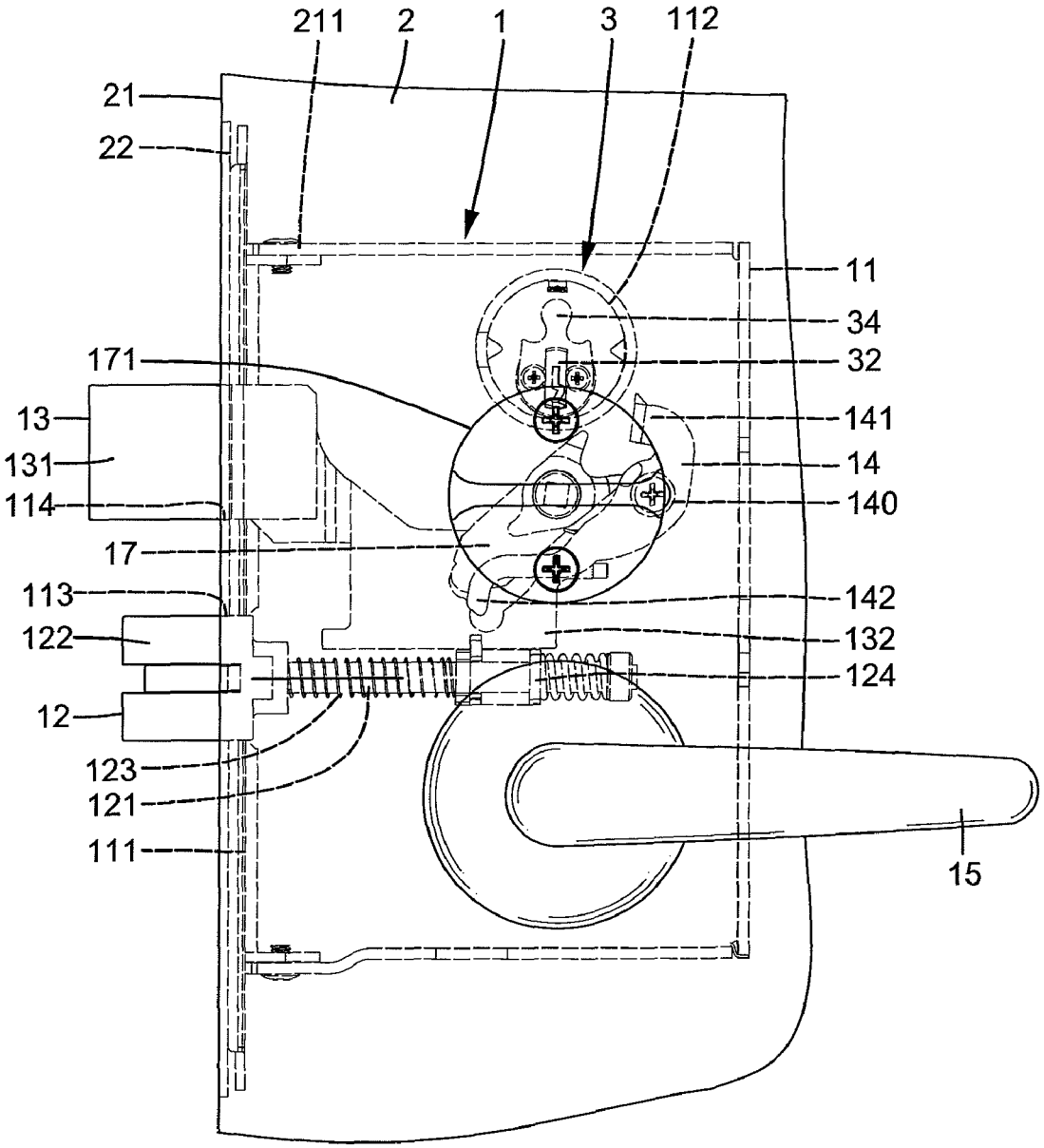
FIG. 13 shows a cross sectional view similar to FIG. 11, with both of the deadbolt and the latch bolt in extended positions.

FIG. 13 shows deadbolt 13 in the extended, locking position. When second key 5 is inserted into keyway 323 of cylinder plug 32 and rotated to move actuating member 34 in the clockwise direction, the portion of second side 54 of second key 5 is stopped by inner end 331 of first arresting member 33 when cylinder plug 32 rotates about 145°. On the other hand, when second key 5 is inserted into keyway 323 of cylinder plug 32 and rotated to move actuating member 34 in the counterclockwise direction, the portion of second side 54 of second key 5 is stopped by inner end 371 of second arresting member 37 when cylinder plug 32 rotates about 160°. As a result, rear end 132 of deadbolt 13 is not actuated and, thus, does not move outward, for actuating member 34 must rotate about 180° in the clockwise direction to actuate rear end 132 of deadbolt 13. Furthermore, operation of cylinder plug 32 with second key 5 also can not unlatch latch bolt 12 when deadbolt 13 is in the extended, locking position. This is because first end 141 of lever link 14 is outside of the rotation track of actuating member 34 and because second end 142 of lever link 14 is disengaged from bracket 124 of latch bolt 12.

Figure 14:
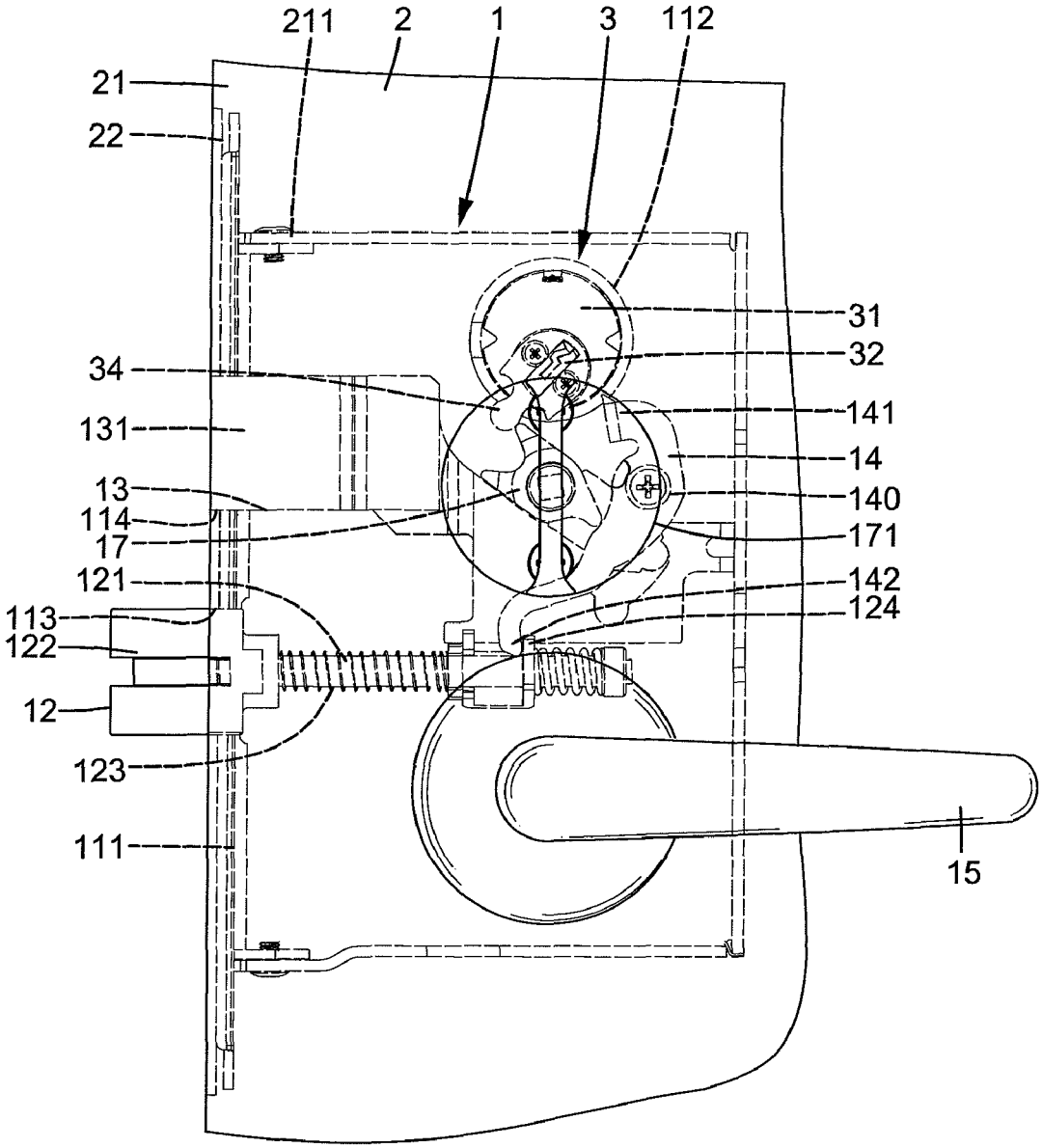
FIG. 14 shows a cross sectional view similar to FIG. 13, with an actuating member rotated through an angle and with the deadbolt moved to the retracted position.

With reference to FIGS. 13 and 14, for unlocking deadbolt 13 from the outdoors, first key 4 is inserted into keyway 323 of cylinder plug 32 and rotated to move actuating member 34 in the clockwise direction. Pivotal member 17 is actuated to move front end 131 of deadbolt 13 from the extended, locking position to the retracted, unlocking position after actuating member 34 is rotated about 180° in the clockwise direction. During moving of deadbolt 13 inward to its retracted, unlocking position, lever link 14 is actuated so that first end 141 of lever link 14 is moved to its original position in the rotation track of actuating member 34 and that second end 142 of lever link 14 is engaged with bracket 124 of latch bolt 12. Thus, latch bolt 12 can be moved to its retracted, unlatching position inside of case 11 by subsequent rotation of actuating member 34 in the clockwise direction about 145°.

As discussed above, when latch bolt 12 is in its extended, unlatching position and deadbolt 13 in its retracted, unlocking position, either of first and second keys 4 and 5 can be used to unlatch latch bolt 12. But when both latch bolt 12 and deadbolt 13 are in the extended positions, only first key 4 can be used to unlock deadbolt 13. Thus, by cooperation of keyed cylinder 3 and first and second keys 4 and 5, first key 4 can unlock both latch bolt 12 and deadbolt 13 of door lock 1 while second key 5 can only unlatch latch bolt 12, allowing keyed cylinder assembly 10 to be utilized in mortise locks for use in hotel room doors. Specifically, first key 4 can be used as a master key to unlock both a latch bolt and a deadbolt of a hotel room door lock from the outdoors, and second key 5 can be used as a service key to unlatch only the latch bolt from the outdoors. Thus, in a case that a room guest is intended to stay longer but refuses to pay the current bill, the hotel manager may move deadbolt 13 to the extended, locking position with first key 4 to prevent the room guest from entering the room before the current bill is paid up. Further, keyed cylinder 3 according to the preferred teachings of the present invention has simplified structure while allowing smooth operation by first and second keys 4 and 5.

It can be appreciated that keyed cylinder assembly 10 according to the preferred teachings of the present invention can be utilized with door lock of any desired type.

Spaced first and second arresting members 33 and 37 of keyed cylinder 3 allow door lock 1 to suit differently handed doors by optionally mounting keyed cylinder 3 in keyed cylinder-receiving hole 112 from either of opposite lateral orientations of case 11. It can be appreciated that keyed cylinder 3 can include only one arresting member 33 or 37.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. A keyed cylinder assembly comprising, in combination:

a keyed cylinder adapted to be mounted in a door lock having a latch bolt and a deadbolt, with keyed cylinder including a hollow body and a cylinder plug rotatably received in the hollow body about an axis, with the cylinder plug including front and rear ends spaced along the axis and an outer periphery surrounding the axis, with the cylinder plug further including a keyway extending from the first end through the second end along the axis and extending from an interior of the cylinder plug to the outer periphery in a radial direction perpendicular to the axis, with the keyway including a radial outer portion in the outer periphery and extending along the axis, with the cylinder plug further including an annular groove formed in the outer periphery and intersecting the radial outer portion of the keyway, with the keyed cylinder further including a first arresting member received in the hollow body and having an inner end received in the annular groove of the cylinder plug, with the inner end of the first arresting member having a first length along the axis;

a first key including a first blade insertable into the keyway of the cylinder plug, with the first blade including a side extending along the axis, with a notch being formed in the side of the first blade and having a second length along the axis not smaller than the first length, with the side of the first blade being received in the radial outer portion of the keyway when the first blade is received in the keyway; and a second key including a second blade insertable into the keyway of the cylinder plug, with the second blade including a side extending along the axis, with the side of the second blade being received in the radial outer portion of the keyway and a portion of the second side being received in the annular groove of the cylinder plug when the second blade is received in the keyway, wherein when the first blade of the first key is inserted into the keyway of the cylinder plug and rotated, the cylinder plug rotates together with the first key, and the inner end of the first arresting member is received in the notch when the outer end of the keyway of the cylinder plug rotates to a first position in alignment with the inner end of the first arresting member, allowing 360° rotation of the cylinder plug in the hollow body for unlocking both the latch bolt and the deadbolt of the door lock, and wherein when the second blade of the second key is inserted into the keyway of the cylinder plug and rotated in a first direction, the cylinder plug rotates together with the second key until the portion of the second side of the second key contacts and is stopped by the inner end of the first arresting member when the radial outer portion of the keyway of the cylinder plug rotates to a second position adjacent to the inner end of the first arresting member, allowing unlatching the latch bolt of the door lock but not allowing 360° rotation of the cylinder plug in the hollow body for unlocking the deadbolt of the door lock, with the annular groove including a bottom wall intersecting the radial outer portion of the keyway at an intersecting section, with the annular groove further including an arcuate recess formed in the intersecting section, and with the inner end of the first arresting member abutting the arcuate recess when the radial outer portion of the keyway of the cylinder plug rotates to the first position in alignment with the inner end of the first arresting member, with the hollow body including first and second ends spaced along the axis and a cylinder plug hole extending from the first end through the second end of the hollow body along the axis, with the cylinder in the cylinder plug hole, with a first through-hole being formed in the second end of the hollow body and extending from an outer circumference of the hollow body to the cylinder plug hole, with the first arresting member being received in the first through-hole, and with the inner end of the first arresting member extending through first through-hole and into the annular groove of the cylinder plug, with the inner end of the first arresting member being angularly spaced from the radial outer portion of the keyway about 156° when the cylinder plug is not rotated by either of the first and second keys, with the hollow body further including a second through-hole in the second end, with the second through-hole extending from the outer circumference of the hollow body to the cylinder plug hole and being angularly spaced from the first through-hole, and with the keyed cylinder assembly further comprising, in combination: a second arresting member received in the second through-hole and having an inner end received in the annular groove of the cylinder plug, with the inner end of the second arresting member having a third length along the axis not larger than the second length along the axis, and wherein when the second blade of the second key is inserted into the keyway of the cylinder plug and rotated in a second direction reverse to the first direction, the cylinder plug rotates together with the second key until the portion of the second side of the second key contacts and is stopped by the inner end of the second arresting member when the radial outer portion of the keyway of the cylinder plug rotates to a third position adjacent to the inner end of the second arresting member, allowing unlatching the latch bolt of the door lock but not allowing 360° rotation of the cylinder plug in the hollow body for unlocking the deadbolt of the door lock.

2. The keyed cylinder assembly as claimed in claim 1, with each of first and second arresting members further including an outer end received in one of the first and second through-holes and adjacent the outer circumference of the hollow body, with a screw being engaged in each of the first and second through-holes and pressing against the outer end of one of the first and second arresting members so that the inner end of one of the first and second arresting members abuts the bottom wall of the annular groove when the radial outer portion of the keyway of the cylinder plug rotates to the first position in alignment with the inner end of the first arresting member or rotates to a fourth position in alignment with the inner end of the second arresting member.

3. The keyed cylinder assembly as claimed in claim 2, with the inner end of the second arresting member being angularly spaced from the radial outer portion of the keyway about 166° when the cylinder plug is not rotated by either of the first and second keys.

* * * * *